US005417585A

United States Patent [19]

Morin et al.

[11] Patent Number: 5,417,585

[45] Date of Patent: May 23, 1995

[54] VISUALLY KEYED CONNECTOR AND PLUG ASSEMBLIES

[75] Inventors: Scott F. Morin, Harrisburg; Clark S. Hammaker, Middletown; Ronald J. Baker, York, all of Pa.

[73] Assignee: The Whitaker Corporation, Wilmington, Del.

[21] Appl. No.: 274,616

[22] Filed: Jul. 13, 1994

[51] Int. Cl.[6] ..... H01R 3/00

[52] U.S. Cl. ..... 439/488; 439/607; 439/540

[58] Field of Search ..... 439/79, 80, 444, 488, 439/491, 540, 607-610, 701

[56] References Cited

U.S. PATENT DOCUMENTS 4,202,351 5/1980 Biche ..... 128/696
4,704,091 11/1987 Owens et al. ..... 439/281
4,781,619 11/1988 Ikeda ..... 439/488
4,784,614 11/1988 Sadigh-Behzadi ..... 439/488
4,820,193 4/1989 Noorily ..... 439/488
4,902,244 2/1990 Endo et al. ..... 439/489
5,037,330 8/1991 Fulponi et al. ..... 439/607
5,051,870 9/1991 Companion ..... 361/405
5,114,363 5/1992 Mitra ..... 439/491

*Primary Examiner*—Khiem Nguyen

[57] ABSTRACT

Visually keyed connector (10) and plug assemblies (36) wherein the insulative housings (16,38) are formed of material of the same color only when the number and configuration of the terminal receiving cavities (22) of the connector and the contacts (42) of the plug have mating compatibility. The connector and plug assemblies have their mating faces (20,40) exposed to provide a visual indication of such compatibility.

4 Claims, 2 Drawing Sheets

VISUALLY KEYED CONNECTOR AND PLUG ASSEMBLIES

BACKGROUND OF THE INVENTION

This invention relates to interconnectable electrical connector and plug assemblies and, more particularly, to such assemblies which are visually keyed for mating compatibility.

U.S. Pat. No. 5,037,330 to Fulponi et al, the contents of which are hereby incorporated by reference, discloses a shielded stacked circular DIN electrical connector assembly wherein upper and lower connector housings are stacked and enclosed within a metal shield which only exposes the mating faces of the connector housings. With such an assembly, it is possible that the upper and lower connectors have different configurations and numbers of terminals so that an electrical plug assembly which mates with one of the connectors will not mate with the other connector. Such stacking is typically appropriate for mini DIN connectors because of their small size. Because of this small size, the exposed electrical contacts extending out of the mating face of a mating plug assembly are fragile. Accordingly, if a user attempts to mate a mismatched plug and connector, damage can result. It is therefore a primary object of the present invention to provide an arrangement which minimizes the likelihood of the user attempting to mate mismatched components.

SUMMARY OF THE INVENTNION

The foregoing, and additional, objects of the present invention are attained by providing a connector assembly of the type disclosed in the referenced '330 patent wherein the connector housing is of a predetermined color which uniquely corresponds to the number and configuration of terminal receiving cavities at its mating face. This mating face is exposed through the metal shield which surrounds the connector housing. Each of the plug assemblies for connection to the connector assembly has a housing with a mating face and a plurality of electrical contacts extending out of the mating face. A shield surrounding the plug housing has an opening exposing the plug housing mating face. Each plug housing is formed of a material having the same color as the color of the connector housing with which it is matable. Accordingly, the user can determine which plug to insert in which connector merely by examining the exposed colors of the plug and connector.

In accordance with an aspect of this invention, the plug assembly has an insulating boot surrounding the plug shield, and the boot is formed of a material of the same color as the material of the plug housing.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
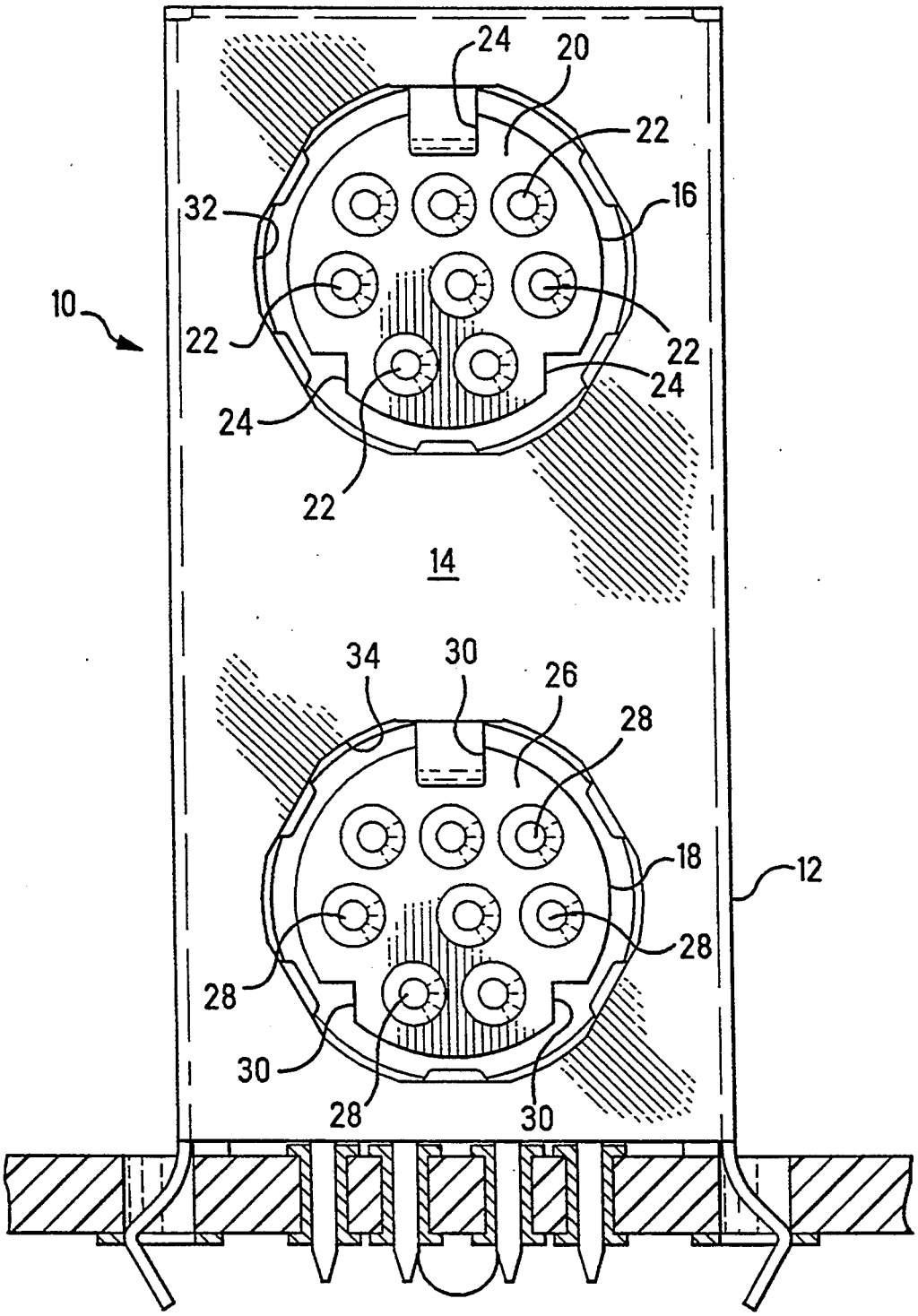
FIG. 1 is a front view of a connector assembly mounted to a circuit board and constructed in accordance with the principles of this invention.

As shown in FIG. 1, and as fully described in the referenced '330 patent, the circular DIN electrical connector assembly designated generally by the reference numeral 10 includes a metal shield 12 having a front wall 14. Disposed within the shield 12 are a pair of stacked connector housings 16 and 18. The upper connector housing 16 has a mating face 20 and a plurality of terminal receiving cavities 22 open to the mating face 16 as well as to a terminal receiving face (not shown) of the housing 16. The cavities 22 are of a predetermined number (illustratively eight) and configuration where they are open to the mating face 20. The housing 16 is also formed with axially extending keyways 24 to assist in orienting the mating plug, as is known in the art. A plurality of electrical terminals (not shown) are each retained in a respective one of the cavities 22.

Similarly, the lower connector housing 18 has a mating face 26, a plurality, illustratively six, of terminal receiving cavities 28 and a plurality of axial keyways 30. Thus, the number and configuration of the terminal receiving cavities 28 on the mating face of the lower connector housing is different from the number and configuration of the terminal receiving cavities 22 on the mating face of the upper connector housing 16.

The front wall 14 of the shield 12 is provided with an upper aperture 32 and a lower aperture 34 through which the mating faces 20 and 26, respectively, are exposed.

The connector housings 16, 18 are typically molded of an insulative plastic material. In accordance with the principles of this invention, the color of the housing material is chosen to correspond with the particular number and configuration of the terminal receiving cavities open to its mating face. Thus, for example, the upper connector housing 16 may be formed of black material, whereas the lower connector housing 18 may be formed of gray material.

Figure 2:
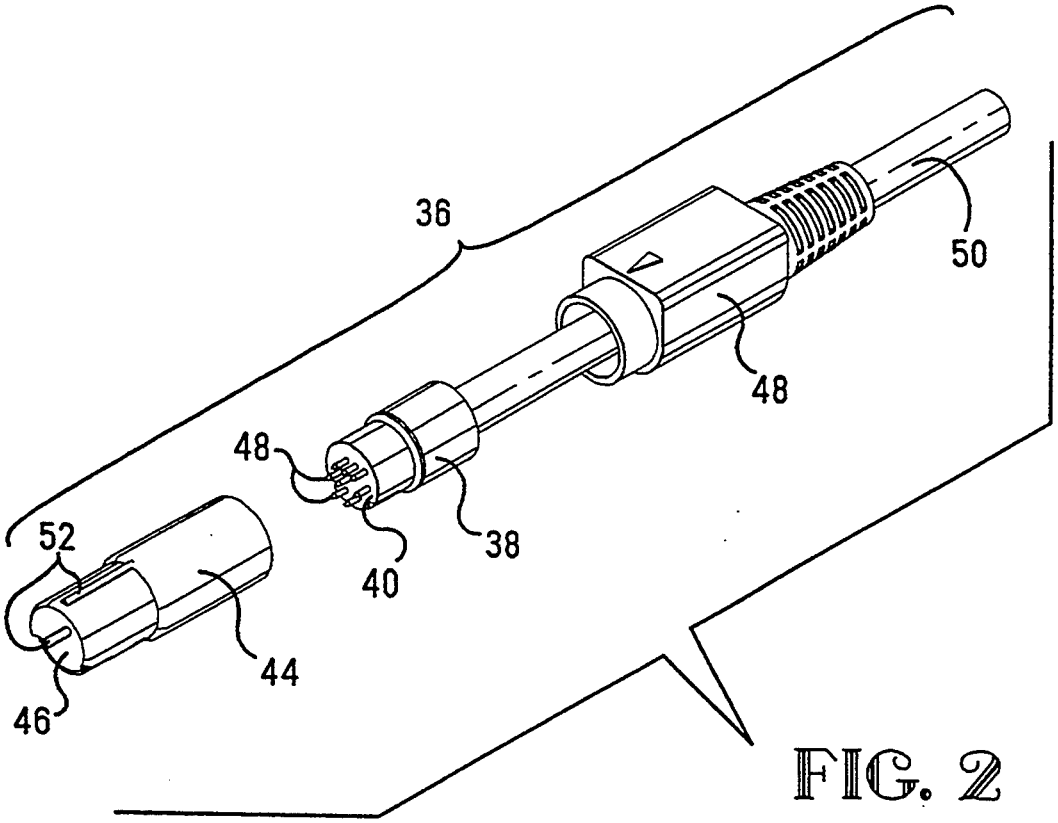
FIG. 2 is an exploded perspective view of a plug assembly constructed in accordance with the principles of this invention.
Figure 3:
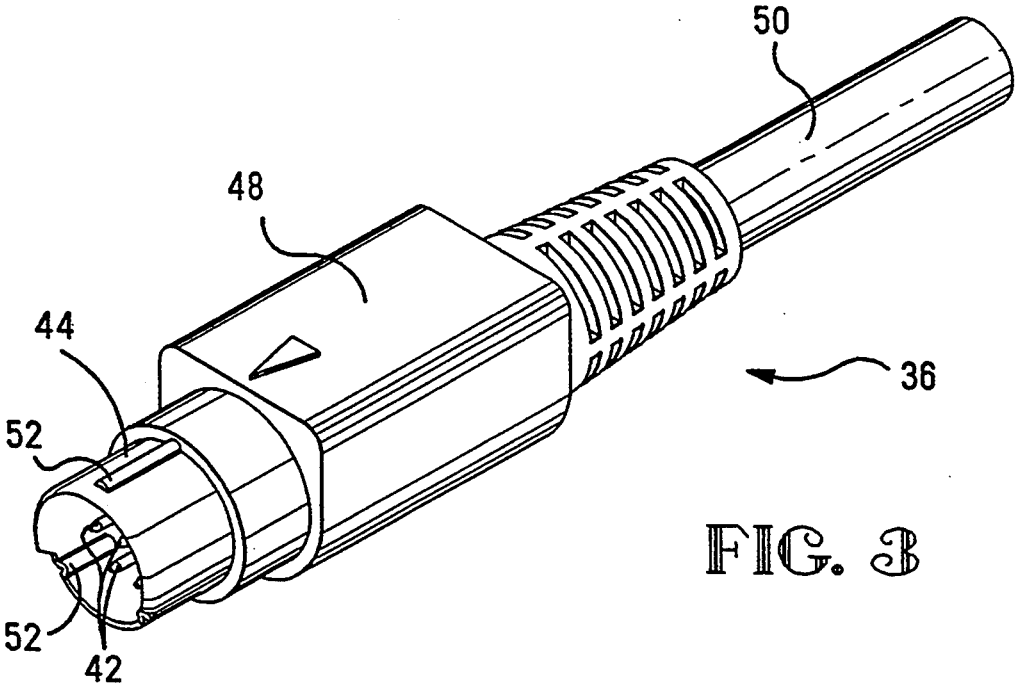
FIG. 3 is a perspective view of the assembled plug assembly of FIG. 2.

As shown in FIGS. 2 and 3, a plug assembly, designated generally by the reference numeral 36, includes an insulative plug housing 38 having a mating face 40. A plurality of electrical contacts 42 extend out of the mating face 40 and are of a particular number and configuration to mate with respective terminals of a complementary electrical connector assembly. A metal shield 44 surrounds the plug housing 38 and has an opening 46 which exposes the mating face 40 of the plug housing 38. An insulative boot 48 which typically terminates insulation 50 surrounding a cable having individual wires connected to the contacts 42, as is known in the art, surrounds the shield 44. The boot 48 leaves exposed a forward mating end of the shield 44, which is formed with inwardly extending projections 52 of appropriate number and connection to be complementary to the keyways 24, 30 of the mating connector housing.

The plug housing 38 and the boot are typically formed of molded insulative plastic material. In accordance with the principles of this invention, the color of the material of the housing 38 and the material of the boot 48 is chosen to be the same as the color of the housing having the particular number and configuration of terminal receiving cavities with which the contacts 42 of the plug assembly 36 are designed to mate.

Thus, when a user wishes to install a plug assembly in a connector, the color of the connector which is visible through the aperture of the connector shield provides a visual indication to the user that only a cable terminated by a plug assembly having an exposed mating face and boot of the same color should be utilized, thereby minimizing the risk of damage to either the connector or the plug.

Accordingly, there have been disclosed interconnectable electrical connector and plug assemblies which are visually keyed for mating compatibility. While an illustrative embodiment of the present invention has been disclosed herein, it is understood that various modifications and adaptations to the disclosed embodiment will be apparent to those of ordinary skill in the art and it is only intended that this invention be limited by the scope of the appended claims.

What is claimed is:

1. An assembly of interconnectable components comprising:

a shielded electrical connector assembly including:

an insulative connector housing having a mating face, a terminal receiving face, and a plurality of terminal receiving cavities open to said mating face and said terminal receiving face, said cavities being of a predetermined number and configuration where open to said mating face, said connector housing being formed of a material having a predetermined color uniquely corresponding to said predetermined number and configuration of said cavities;

a plurality of electrical terminals each retained in a respective one of said cavities; and a metal connector shield enclosing said connector housing, said connector shield having a front wall with an aperture exposing said connector housing mating face; and a shielded electrical plug assembly including:

an insulative plug housing having a mating face and a plurality of electrical contacts extending out of said mating face in number and configuration to mate with respective terminals of a complementary electrical connector assembly, said insulating plug housing being formed of a material having said predetermined color only when said plurality of electrical contacts is of a number and configuration for mating with the terminals of an electrical connector assembly having a connector housing of said predetermined color;

a metal plug shield surrounding said plug housing and having all opening exposing said plug housing mating face; and an insulative boot surrounding said plug shield, said boot leaving exposed a forward mating end of said plug shield;

whereby a connector assembly and a plug assembly have exposed material of the same color only when they are matable so as to provide a visual indication of interconnectability.

2. The assembly according to claim 1 wherein said insulative boot is formed of a material of the same color as the material of said plug housing.

3. An assembly of interconnectable components comprising:

a stacked shielded electrical connector assembly including:

at least two insulative connector housings each having a generally planar mating face, a terminal receiving face, and a plurality of terminal receiving cavities open to said mating face and said terminal receiving face, said cavities in each of said connector housings being of a respective predetermined number and configuration where open to the mating face of said each connector housing, said each connector housing being formed of a material having a respective predetermined color uniquely corresponding to said respective predetermined number and configuration;

a plurality of electrical terminals each retained in a respective one of said cavities; and a metal connector shield enclosing and retaining said at least two connector housings in stacked relation with their mating faces being generally coplanar, said connector shield having a front wall with at least two apertures each exposing a respective enclosed connector housing mating face; and a plurality of shielded electrical plug assemblies, each of said plug assemblies including:

an insulative plug housing having a mating face and a plurality of electrical contacts extending out of said mating face in number and configuration to mate with respective terminals of a complementary electrical connector assembly housing, said insulating plug housing being formed of a material having a particular color only when said plurality of electrical contacts is of a number and configuration for mating with the terminals of a connector housing of said particular color;

a metal plug shield surrounding said plug housing and having an opening exposing said plug housing mating face; and an insulative boot surrounding said plug shield, said boot leaving exposed a forward mating end of said plug shield;

whereby a connector assembly housing and a plug assembly have exposed material of the same color only when they are matable so as to provide a visual indication of interconnectability.

4. The assembly according to claim 3 wherein each of said insulative boots is formed of a material of the same color as the material of the respective plug housing.

* * * * *